United States Patent [19]

Hasegawa et al.

[11] Patent Number: 4,820,175

[45] Date of Patent: Apr. 11, 1989

[54] ELECTRICAL CONNECTOR FOR AN ELECTRICAL CABLE

[75] Inventors: Izumi Hasegawa; Takashi Kamono, both of Yokohama, Japan

[73] Assignee: AMP Incorporated, Harrisburg, Pa.

[21] Appl. No.: 938,082

[22] PCT Filed: Mar. 24, 1986

[86] PCT No.: PCT/US86/00595

§ 371 Date: Nov. 28, 1986

§ 102(e) Date: Nov. 28, 1986

[87] PCT Pub. No.: WO86/06553

PCT Pub. Date: Nov. 6, 1986

[30] Foreign Application Priority Data

Apr. 25, 1985 [JP] Japan ..... 60-089878

[51] Int. Cl.[4] ..... H01R 4/66

[52] U.S. Cl. ..... 439/98; 439/106; 439/449

[58] Field of Search ..... 439/98, 103, 106, 101, 439/109, 460, 449

[56] References Cited

U.S. PATENT DOCUMENTS 4,094,564 6/1978 Cacolici ..... 339/14 L
4,634,211 1/1987 Poliak et al. ..... 439/106
4,641,904 2/1987 Kosugi et al. ..... 439/98
4,737,117 4/1988 Lockard ..... 439/449

FOREIGN PATENT DOCUMENTS 0072063 2/1983 European Pat. Off. .
0094173 11/1983 European Pat. Off. .

OTHER PUBLICATIONS

Navy Technical Disclosure Bulletin, vol. 10, No. 1, 9/84, Arlington, pp. 81–84.

*Primary Examiner*—Gil Weidenfeld
*Assistant Examiner*—Paula A. Austin
*Attorney, Agent, or Firm*—William B. Noll; Adrian J. LaRue; Gerald K. Kita

[57] ABSTRACT

An electrical connector comprises a plurality of signal contacts (20,30) disposed in two rows in an insulating housing (10) and each having one end for connection to respective signal wires (S) in an electric cable (1) and another end for connection with a signal terminal of a member to which the connector is to be connected, a plurality of ground contacts (62) disposed in a row between the two rows of signal contacts (20,30) and having one end for connection to ground wires (G) in the cable (1) and another end for connection with a ground terminal of the member to which the connector is connected, and a shield member (60) disposed between the signal contacts to prevent crosstalk therebetween.

20 Claims, 8 Drawing Sheets

ELECTRICAL CONNECTOR FOR AN ELECTRICAL CABLE

This invention relates to an electrical connector for terminating electric cables such as a transmission cable which is used for the internal signal wiring of a computer or the like and particularly connecting to a post header mounted on the printed circuit board.

A transmission cable for the internal signal wiring of a computer has a plurality of signal wires. The arrangement of the signal wires in an insulating jacket of the cable gives rise to a problem of crosstalk, i.e., unwanted exchange of signals between the adjacent signal wires. An electric cable is known which comprises a plurality of signal wires disposed in parallel to one another in a plane in an insulating jacket and a plurality of ground wires each disposed between alternate adjoining or adjacent signal wires to provide protection against crosstalk.

Crosstalk between the adjoining signal wires can be avoided by using this kind of cable. However, in an electrical connector establishing an electrical connection between the signal and ground wires of the cable terminated respectively to the signal and ground contacts in the connector and a printed circuit board, there is likely to arise quite a bit of difficulty in the connection between the ground wires and the ground terminals of the printed substrate. An electrical connector is known for connecting the ground wires of an electric cable to the ground terminals of a printed substrate. According to this connector, a part of the contacts which are connected to the signal wires is also connected to the ground wires for connecting them to the ground terminals on the printed circuit board. This connector has the advantage in that the crosstalk between the signal contacts adjoining ground contacts can be avoided by using some of the signal contacts as ground contacts. However, on the other hand, the connector has the disadvantage because since some signal contacts are used as ground contacts, the number of signal contacts to transmit signals decreases. This is especially true when the number of signal contacts are further decreased when the number of signal contacts to be protected must be increased.

Under these circumstances, it is an object of this invention to provide an electrical connector which can satisfactorily prevent the crosstalk between signal contacts without decreasing the density required to accommodate increased cable size in the number of signal conductors.

The electrical connector of this invention comprises a plurality of signal contacts disposed in two rows in an insulating housing and each having one end for connection to respective signal wires in an electric cable and another end for connection with a signal terminal of a member to which the connector is to be connected, a plurality of ground contacts disposed in a row between the two rows of signal contacts and having one end for connection to ground wires in the cable and another end for connection with a ground terminal of the member to which the connector is connected, and shield plates disposed between the signal contacts to prevent crosstalk therebetween.

The invention is illustrated by the accompanying drawings of which a brief description follows.

Figure 1:
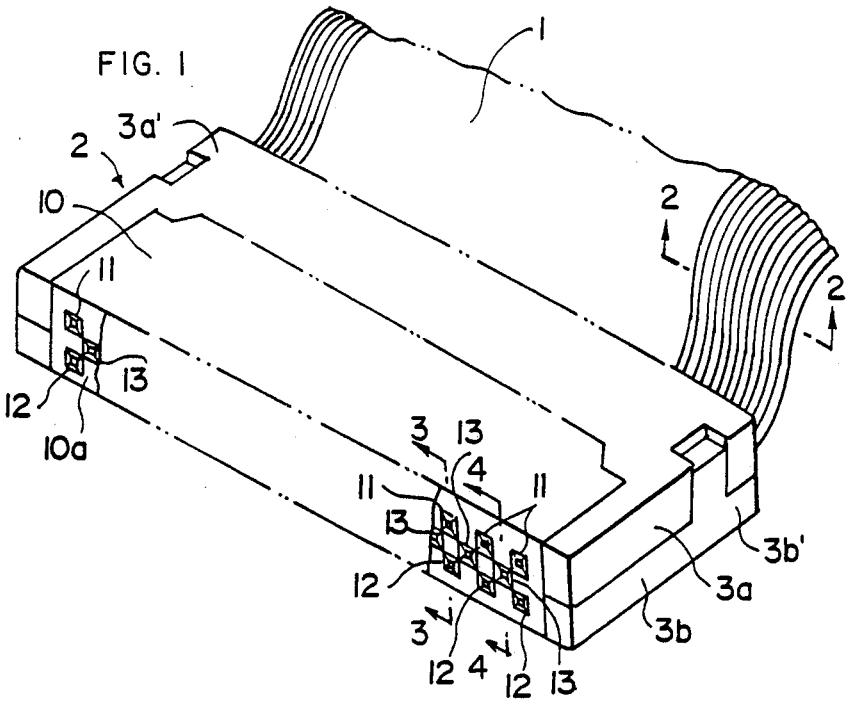
FIG. 1 is a perspective view of an electrical connector embodying this invention.
Figure 3:
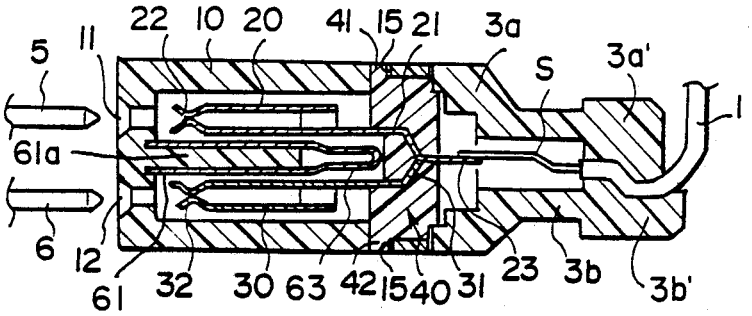
Figure 4:
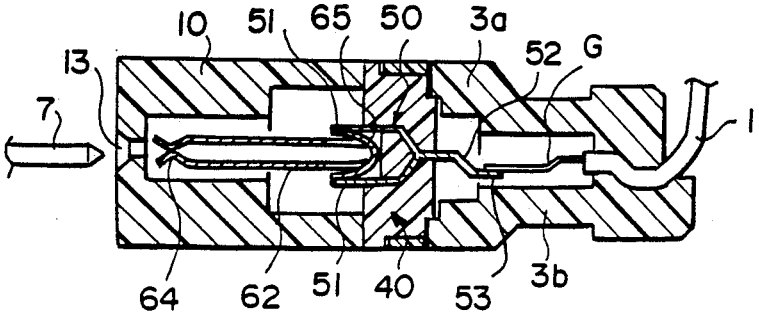

FIGS. 3 and 4 are cross-sectional views of the connector shown in FIG. 1 which are taken along the lines 3—3 and 4—4, respectively, of FIG. 1.

Figure 5:
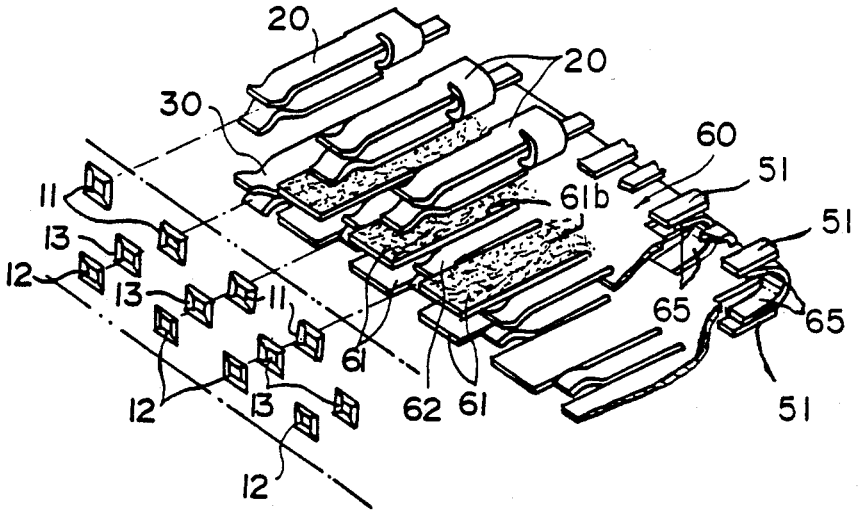

FIG. 5 is a perspective view of the contacts in the connector of FIG. 1.

FIGS. 6 to 12 are views showing a process for the preparation of a contact assembly for the electrical connector of this invention, in which FIGS. 6A, 7A, 8A, 9A, 10A, 11A and 12A are each a front elevational view of the assembly. FIGS. 6B, 7B, 8B, 9B, 10B, 11B and 12B are each a side elevational view thereof, and FIGS. 8C, 9C and 10C are each a bottom plan view thereof.

Figure 13A:
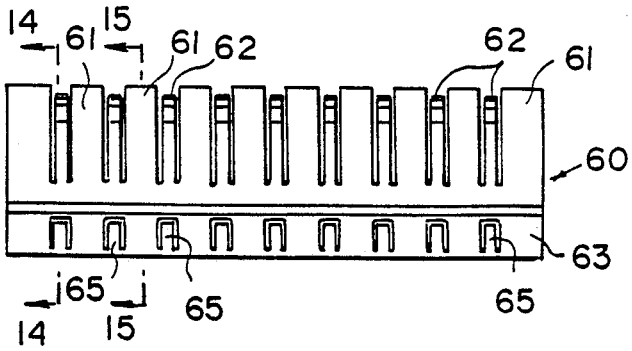
Figure 13B:
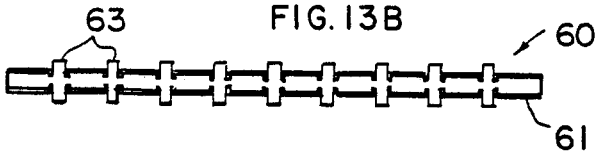

FIGS. 13A and 13B are a front elevational view and a bottom plan view, respectively, of the ground plate in the connector of this invention.

Figure 14:
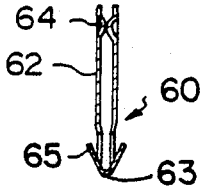
Figure 15:
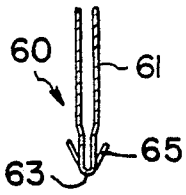

FIGS. 14 and 15 are cross-sectional views of the ground plate taken along the lines 14—14 and 15—15, respectively, of FIG. 13A.

Figure 16A:
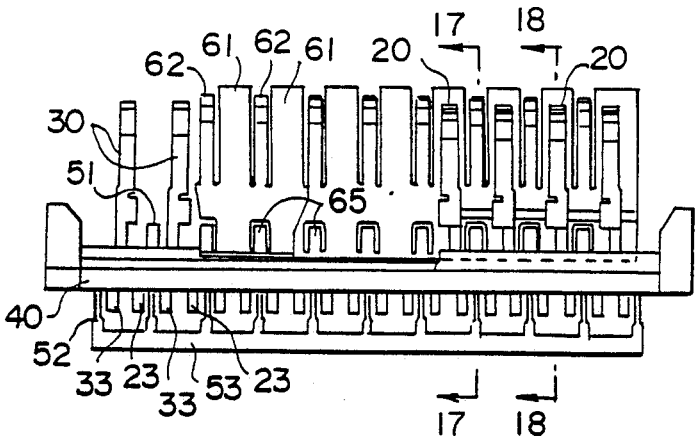
Figure 16B:
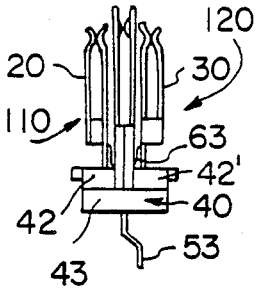

FIGS. 16A and 16B are a front elevational view and a side elevational view, respectively, of the assembly of FIG. 12 and the ground plate of FIG. 13 connected thereto.

Figure 17:
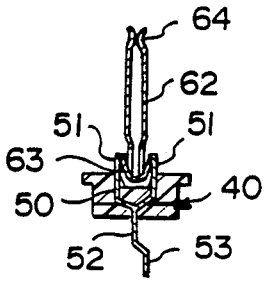
Figure 18:
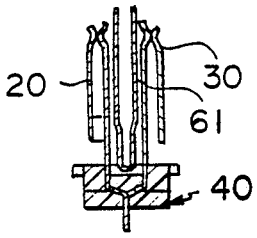

FIGS. 17 and 18 are sectional views taken along the lines 17—17 and 18—18, respectively, of FIG. 16A.

The invention will now be described by way of example with reference to the drawings.

Figure 2A:
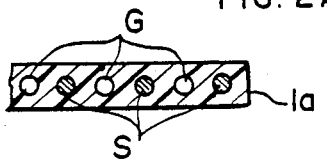
FIGS. 2A and 2B are cross-sectional views of the cable shown in FIG. 1 which are taken along the line 2—2 of FIG. 1.
Figure 2B:
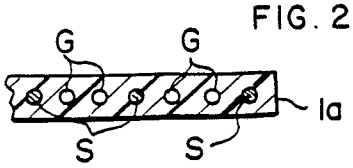

FIG. 1 is a perspective view of an electrical connector 2 embodying this invention and is electrically connected to a transmission cable 1 which is used for the internal wiring of a computer, or the like. Transmission cable 1 includes a plurality of signal wires S and a plurality of ground wires G which are disposed in mutually parallel and alternating relation in an insulating jacket 1*a*, as shown in FIG. 2A. It is alternatively possible to dispose two ground wires G between every two adjacent signal wires S, as shown in FIG. 2B. In either event, ground wires G shield adjacent signal wires S from each other to prevent any crosstalk therebetween.

Electrical connector 2 includes a plurality of signal contacts and a plurality of ground contacts disposed in a housing 10 formed from a suitable insulating material. The signal contacts are to be connected to the signal wires in the cable, and the ground contacts are to be connected to the ground wires. The terminating portions terminated to the signal and ground wires are surrounded by an upper cover 3*a* and a lower cover 3*b* which include strain relief sections 3*a*′ and 3*b*′ that engage cable 1.

Housing 10 has a front end wall 10*a* provided with holes through which male terminals are inserted for making contact with contact portions of the signal and ground contacts. The holes are provided in three rows one above another. Holes 11 in the upper row and hole 12 in the lower row as shown in FIG. 3 are used for the insertion of male terminals 5,6 for making electrical contact with the signal contacts. Holes 13 in the middle row are used for the insertion of male terminals 7 for making electrical contact with the ground contacts. Holes 13 are provided in staggered relation with respect to holes 11 and 12, so that the spacing between the male terminals may be maximized to facilitate wiring located on the printed substrate on which the male terminals are preferably disposed. If the male terminals to be inserted have a large spacing therebetween, holes 13 do not necessarily need to be arranged in staggered relation relative to the other holes, but they can be arranged in a grid pattern.

The staggered arrangement has the advantage of enabling the addition of the male terminals for making electrical contact with the ground contacts without any change having to be made in the conventional arrangement of the male terminals for making electrical contact with the signal contacts. This renders it no longer necessary to use a part of the male signal terminals as ground terminals. Therefore, the connector has a high packaging density.

The internal construction of electrical connector 2 will now be described with reference to FIGS. 3 and 4. Housing 10 is provided therein with a plurality of upper signal contacts 20 and a plurality of lower signal contacts 30. Each of contacts 20 has a bifurcated contact end 22 facing one of upper holes 11 and each of contacts 30 has a bifurcated contact end 32 facing one of lower holes 12. Opposite or base ends 21 and 31 of contacts 20 and 30, respectively, are secured by insert molding in a holding member 40 made of a suitable insulating material.

Holding member 40 has an upper projection 41 and a lower projection 41*a* which are fitted in the slots 15 formed in housing 10, whereby holding member 40 is secured to housing 10. An extreme end 23 of each contact 20 and an extreme end 33 (see FIG. 12A) of each contact 30 project backwardly from holding member 40. One of signal wires S in cable 1 is connected to each of the ends 23,33 of contacts 20,30 in the area surrounded by upper and lower covers 3*a* and 3*b*.

Figure 12A:
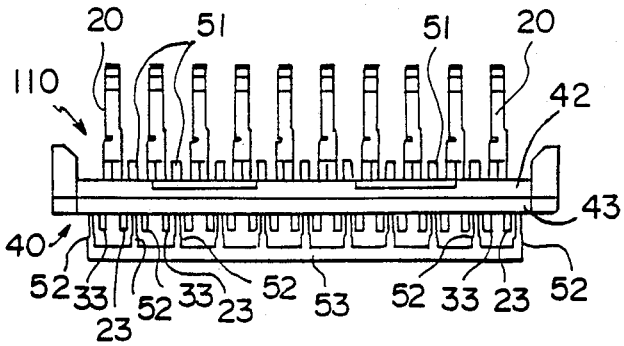

Although it appears from FIG. 3 that the ends of upper and lower signal contacts 20 and 30 may be joined together, they are spaced apart from each other in a direction perpendicular to the sheet of the drawing as shown in FIG. 12A and contacts 20 and 30 are connected to different signal wires S.

A shielding plate 61 is provided between upper and lower signal contacts 20 and 30 and is mounted on support member 61*a* of housing 10. Shielding plate 61 forms an integral part of ground contacts 62, which are shown in FIGS. 4 and 5, and extends in the direction in which the ground contacts are arranged. Shielding plate 61 is grounded and thereby prevents any crosstalk between contacts 20 and 30.

Contacts 20 and 30 are stamped and formed from a suitable metal having desirable spring characteristics and contact ends 22 and 32 thereof resiliently flex to receive male signal terminals 5 and 6 inserted through holes 11 and 12 of housing 10 to establish electrical contact therewith. As bifurcated contact ends 22 and 32 are moved apart by male terminals 5 and 6 and are likely to engage shielding plate 61, those surfaces of shielding plate 61 which face ends 22 and 32 are each coated with a suitable insulating film 61*a* which prevents the grounding of the signal transmitted through contacts 20 or 30 even if ends 22 or 32 may engage shielding plate 61.

As shown in FIG. 4, a plurality of ground base members 50 are secured in holding member 40 in housing 10. Each ground base member 50 has a rear terminating end 52 to which one of ground wires G in cable 1 is connected. Ground base member 50 has bifurcated front ends 51 between which resilient contacts 65 of base end 63 is secured. Base end 63 is resiliently held in position when resilient contacts 65 are press-fitted between front ends 51. Each ground contact 62 has a contact end 64 which resiliently flex to receive male ground terminal 7 inserted through one of holes 13 for making electrical contact with terminal 7 and thereby connecting the corresponding ground wire G in cable 1 to ground. As ground contact 62 is integral with shielding plate 61, they are both connected to ground by male terminal 7 and thereby effectively prevent crosstalk between signal contacts 20 and 30.

FIG. 5 is a perspective view of the upper and lower signal contacts 20 and 30, ground contacts 62 and shielding plate 61 disposed in housing 10. Upper signal contacts 20 lie in a row aligned with the upper row of holes 11, and the lower signal contacts 30 form a row aligned with the lower row of holes 12. An integral ground plate 60 which comprises shielding plate 61 and ground contacts 62 are arranged between the upper row of signal contacts 20 and the lower row of signal contacts 30 in such a way that shielding plate 61 and ground contacts 62 lie in alternating relation in a row. Ground plate 60 having shielding plate 61 and ground contacts 62 is stamped and formed from a suitable metal having desirable spring characteristics and includes base end 63 including resilient contacts 65 which are to be press-fitted between front ends 51 of ground base member 50.

The further construction of the invention will now be described with the following description of a process for making signal contacts 20 and 30 and ground plate 60.

Figure 6A:
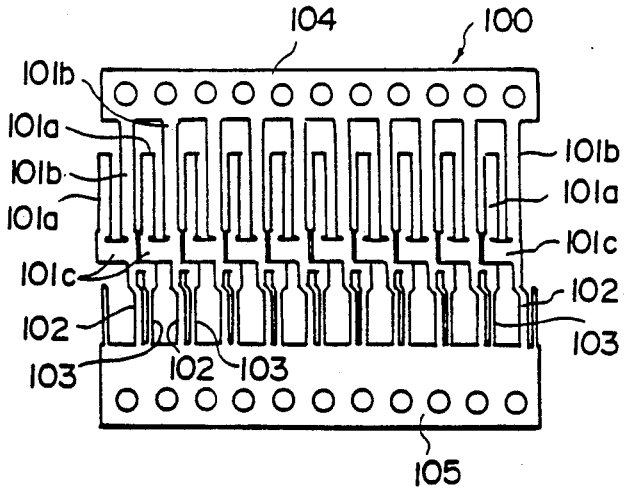
Figure 6B:
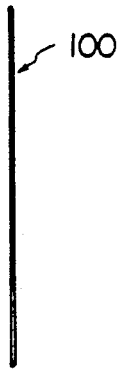

First, a conductive metal plate 100 is formed in strip form shown in FIGS. 6A and 6B. Plate 100 has a plurality of pairs of strips 101*a* and 101*b* connected by a portion 101*c* and defining contact ends 22 or 23 of signal contacts 20 or 30. A pair of carrier strips 104 and 105 hold the contacts together during the manufacture thereof. A plurality of strips 102 extend from the lower carrier strip 105 and are used to form rear ends 21 of the signal contacts to which signal wires S in cable 1 are connected. A plurality of strips 103 which are narrower than strips 102 extend from carrier strip 105 and are used to form ground base members 50.

Figure 7A:
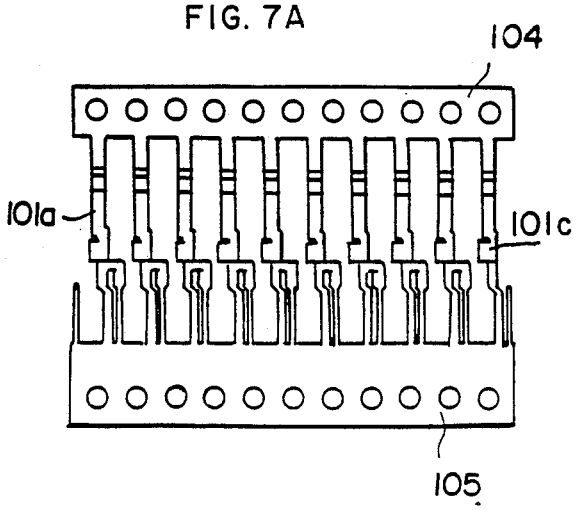
Figure 7B:
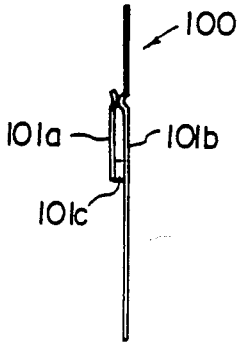

Referring to FIGS. 7A and 7B, each connecting portion 101*c* is bent at right angles to strip 101*b* and strip 101*a* is bent at right angles to connection portion 101*c*, so that connection portion 101*c* forms a U-shaped configuration. Then, the outer end of strip 101*a* and the corresponding portion of strip 101*b* are bent as shown in FIG. 7B so that they form the shape of contact end 22 of a signal contact.

Figure 8A:
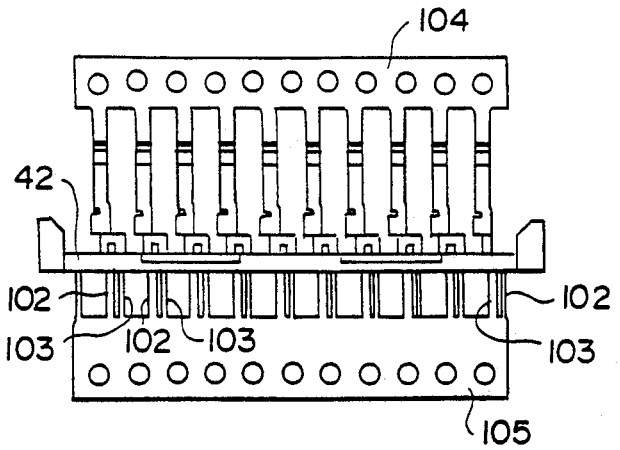
Figure 8B:
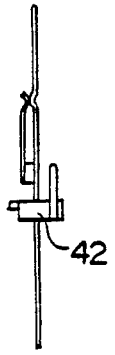
Figure 8C:
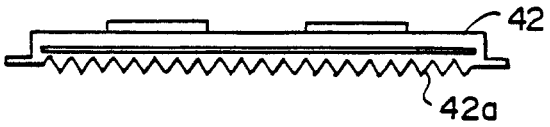

Referring now to FIGS. 8A to 8C, a first holding portion 42 is formed by insert molding of insulating material around the upper end portions of strips 102 and 103. First holding portion 42 has a serrated bottom surface 42*a* which will be used for positioning first holding portion 42 relative to another first holding portion 42' as shown in FIGS. 10–12 and as will hereinafter be described.

Figure 9A:
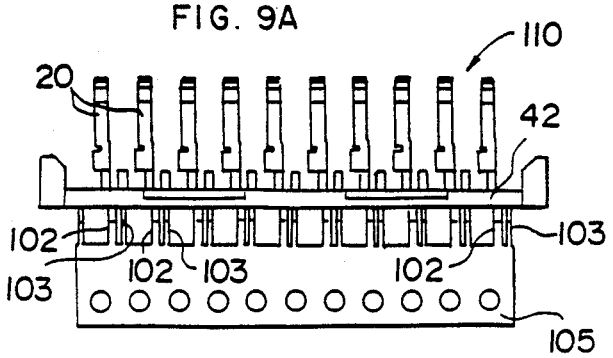
Figure 9B:
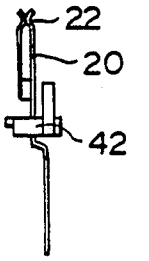
Figure 9C:
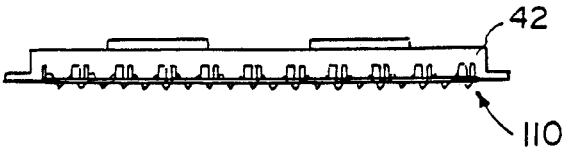

Then, upper carrier strip 104 is cut away from signal contacts 20, as shown in FIGS. 9A to 9C. Then, the inner end portions of strips 102 and 103 are bent as shown in FIG. 9B.

Figure 10A:
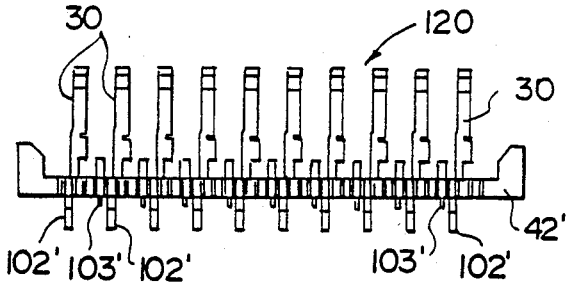
Figure 10B:
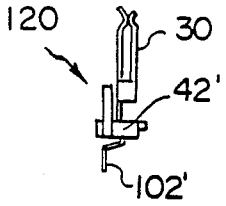
Figure 10C:
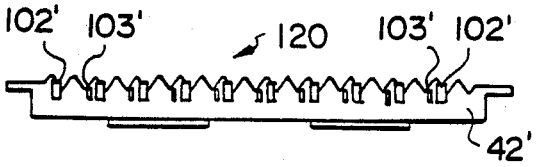

The foregoing is a description of the process for the preparation of a signal contact assembly 110 which defines one of the two rows of signal contacts in the connector of this invention. An assembly 120 defining the other row of signal contacts can be made by a similar process. It is substantially symmetrical to assembly 110, as shown in FIGS. 10A to 10C. Assembly 120 does not, however, have any lower carrier strip 105, but only strips 102' and 103' project downwardly from first holding portion 42'.

Figure 11A:
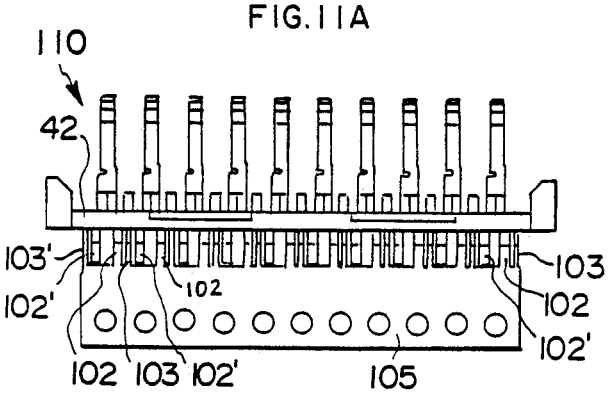
Figure 11B:
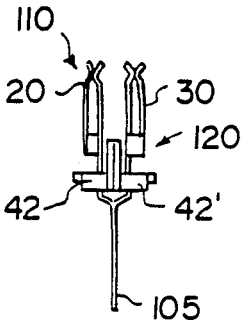

Then, the serrated surfaces of the first holding portions 42 and 42' are engaged with each other to join the two assemblies 110 and 120, as shown in FIGS. 11A and 11B. Strips 103 and 103', which form the rear end 52 of ground base member 50, are joined together one upon the other, but strips 102 and 102', which form the rear ends of signal contacts 20 and 30, are spaced apart from each other between the adjoining strips 103.

Figure 12B:
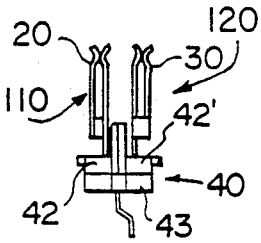

The second holding portion 43 is formed by insert molding of a suitable insulating material under first holding portions 42 and 42' of assemblies 110 and 120 so that assemblies 110 and 120 are joined together, as shown in FIGS. 12A and 12B. First holding portions 42 and 42' and second holding portion 43 form holding member 40 shown in FIGS. 3 and 4. Lower carrier strip 105 is cut away and a connecting strip 53 holds the rear ends 52 of the ground base members 50, as shown in FIG. 12A. Rear ends 23 and 33 of signal contacts 20 and 30 are located between adjoining rear ends 52 of base members 50 in mutually spaced apart relation. Front ends 51 of each base member 50 are defined by a pair of strips spaced apart from each other and projecting above holding member 40.

FIG. 13A is a front elevational view of ground plate 60 integrally having ground contacts 62 and shielding plates 61, and FIG. 13B is a bottom plan view thereof. Ground plate 60 comprises a single metal plate bent to form a U-shaped cross section and is formed to include ground contacts 62 and shielding plates 61 in alternating relation, as shown in FIGS. 14 and 15, which are sectional views taken along the lines 14—14 and 15—15, respectively, of FIG. 13A. As shown in FIG. 14, the upper end of each ground contact 62 is bent to form contact end 64 for flexibly receiving male ground terminal 7 and lower base end 63 thereof has resilient contacts 65 extending outwardly therefrom at spaced intervals along base end 63. Each shielding plate 61 is defined by a pair of generally parallel strips, as shown in FIG. 15. Although ground plate 60 has been described as comprising a single U-shaped metal plate, it is alternatively possible to join a pair of plates to form it.

Ground plate 60 is placed between the two rows of signal contacts 20 and 30 in the assemblies shown in FIGS. 12A and 12B. The whole assembly including ground plate 60 is shown in FIGS. 16A and 16B. In order to mount ground plate 60 on base members 50, resilient contacts 65 of ground plate 60 are press-fitted between front ends 51 of base members 50 secured to and projecting upward from holding member 40, as shown in FIG. 17, which is a cross-sectional view taken along the line 17—17 of FIG. 16A. As a result, each shielding plate 61 is located between a pair of signal contacts 20 and 30, as shown in FIG. 18, which is a cross-sectional views taken along the line 18—18 of FIG. 16A.

Although the invention has been described by way of example with reference to an electrical connector for a transmission cable, the electrical connector of this invention can also be used for connecting any other cable that requires shielding, including coaxial cable.

This invention is characterized by including two rows of signal contacts and a row of ground plates disposed between the two rows of signal contacts. The ground plates shield adjoining signal contacts from each other and thereby prevent any crosstalk therebetween. Each ground contact is exclusively connected to a ground terminal and it is no longer necessary to employ a part of signal contacts for grounding purposes. Therefore, the electrical connector of this invention has a high packaging density.

We claim:

1. An electrical connector for connection to signal conductors and ground conductors of an electrical cable comprising an insulating housing member having signal contacts and ground contacts disposed therein for electrical connection respectively to the signal conductors and ground conductors of the electrical cable, wherein said signal contacts are disposed in said housing member in two rows and have contact sections in alignment with respective holes at a front end of said housing member for electrical connection with respect signal terminal members;

said ground contacts are disposed in a row between said two rows of said signal contacts and have contact sections in alignment with respective holes at said front end of said housing member for electrical connection with respective ground terminal members;

a shield plate member is disposed in said housing member between said two rows of said signal contacts to prevent crosstalk between the signal contacts;

said signal contacts and ground contacts are secured in an insulating holding member mounted in said housing member;

said holding member comprises holding portions in which the respective signal contacts and ground contacts are secured; and said holding portions have mated serrated surfaces.

2. An electrical connector as claimed in claim 1, wherein said signal contacts are vertically aligned and said ground contacts are offset with respect to said signal contacts.

3. An electrical connector as claimed in claim 1, wherein said shield plate member is supported on support members of said housing member.

4. An electrical connector as claimed in claim 1, wherein said shield plate member and said ground contacts are a unitary ground member.

5. An electrical connector as claimed in claim 4, wherein said shield plate member has a dielectric coating on the surfaces facing the signal contacts.

6. An electrical connector as claimed in claim 4, wherein said shield plate member comprise parallel plate members so that they and said ground contacts alternate with one another and are coplanar.

7. An electrical connector as claimed in claim 4, wherein said unitary ground member has a base end including resilient contacts in electrical engagement with ground base member having rear terminating ends that are commoned via connecting strip.

8. An electrical connector as claimed in claim 1, wherein insulating cover members are secured onto said housing member.

9. An electrical connector as claimed in claim 8, wherein said cover members have strain relief sections.

10. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals; and a shield plate member disposed in said housing between said two rows of said signal contacts to prevent crosstalk between the signal contacts;

said rows of signal contacts being vertically aligned and said ground contacts being offset with respect to said signal contacts.

11. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals; and a shield plate member disposed in said housing between said two rows of said signal contacts to prevent crosstalk between the signal contacts;

said shield plate member and said ground contacts being portions of a unitary ground member;

said shield plate member having a dielectric coating on its surfaces facing said signal contacts.

12. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals; and a shield plate member disposed in said housing between said two rows of said signal contacts to prevent crosstalk between the signal contacts;

said shield plate member and said ground contacts being portions of a unitary ground member;

said shield plate member comprising parallel plate members which alternate with and are co-planar with said ground contacts.

13. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals; and a shield plate member disposed in said housing between said two rows of said signal contacts to prevent crosstalk between the signal contacts;

said shield plate member and said ground contacts being portions of a unitary ground member;

said unitary ground member comprising a base end including resilient contacts in electrical engagement with a ground base member having rear terminating ends that are commoned via a connecting strip.

14. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals; and a shield plate member disposed in said housing between said two rows of said signal contacts to prevent crosstalk between the signal contacts;

said shield plate member being supported on support members of said housing member.

15. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals;

a shield plate member disposed in said housing between said two rows of said signal contacts to prevent crosstalk between the signal contacts; and insulating cover members secured onto said housing member.

16. An electrical connector as claimed in claim 15, wherein said cover members have strain relief sections.

17. An electrical connector for connection to signal conductors and ground conductors of an electrical cable, comprising an insulating housing member having signal contacts and ground contacts disposed therein for electrical connection respectively to the signal conductors and ground conductors of the electrical cable;

said signal contacts being disposed in said housing member in two rows and having contact sections in alignment with respective holes at a front end of said housing for electrical connection with respective signal terminal members;

said ground contacts being disposed in a row between said two rows of said signal contacts and having contact sections in alignment with respective holes at said front end of said housing member for electrical connection with respective ground terminals, and base ends for connection to said ground conductors of said electrical cable;

a shield plate member disposed in said housing between said two rows of said signal contacts to prevent crosstalk between the signal contacts; and ground base members including bifurcated front ends for receiving said base ends of said ground contacts;

said base ends of said ground contacts including resilient contacts press-fitted within said bifurcated front ends of said ground base members.

18. An electrical connector as claimed in claim 17 wherein said base ends of said ground contacts are bifurcated.

19. An electrical connector as claimed in claim 17 wherein said base ends are shaped as arrow heads and press outward.

20. An electrical connector as claimed in claim 17 wherein said shield plate member and said ground contacts form portions of a unitary ground member.

* * * * *